United States Patent [19]

Carolla

[11] Patent Number: 4,822,706

[45] Date of Patent: Apr. 18, 1989

[54] BINDER FOR PHOTOCONDUCTIVE LAYER OF PERSISTENT CONDUCTIVITY-TYPE ELECTROPHOTOGRAPHIC RECORDING MEMBER

[75] Inventor: Donald J. Carolla, Plymouth, Minn.

[73] Assignee: Minnesota Mining and Manufacturing Company, St. Paul, Minn.

[21] Appl. No.: 160,651

[22] Filed: Feb. 26, 1988

[51] Int. Cl.[4] ..... G03G 5/05; G03G 5/08

[52] U.S. Cl. ..... 430/89; 430/96; 430/51

[58] Field of Search ..... 430/96, 89, 51

[56] References Cited

U.S. PATENT DOCUMENTS

| | | | |
|---|---|---|---|
| 3,261,709 | 7/1966 | Shulman | 430/96 X |
| 3,563,734 | 2/1971 | Shely | 430/103 |
| 3,723,115 | 3/1973 | Miyatsuka et al. | 430/96 X |
| 3,764,313 | 10/1973 | Shely | 430/103 |
| 3,929,480 | 12/1975 | Perlis et al. | 430/96 X |
| 4,223,084 | 9/1980 | Peeters et al. | 430/96 X |
| 4,308,334 | 12/1981 | Kinoshita et al. | 430/89 |
| 4,492,747 | 1/1985 | Brechlin | 430/96 |

FOREIGN PATENT DOCUMENTS

| | | | |
|---|---|---|---|
| 715500 | 8/1965 | Canada | 430/89 |
| 0072176 | 2/1983 | European Pat. Off. | 430/96 |

*Primary Examiner*—Roland E. Martin
*Assistant Examiner*—Jeffrey A. Lindeman
*Attorney, Agent, or Firm*—Donald M. Sell; Walter N. Kirn; Robert H. Jordan

[57] ABSTRACT

A persistent conductivity-type electrophotographic recording member comprising a nonconductive layer and a photoconductive layer disposed on one surface of the nonconductive layer, wherein the photoconductive layer comprises a photosensitive material substantially uniformly dispersed in a binder which consists essentially of a copolymer of styrene with at least one alkyl acrylate, the alkyl group of which comprises from four to twelve carbon atoms. The acid value of such copolymers is typically preferably below about 2, and more preferably below about 1.

13 Claims, No Drawings

BINDER FOR PHOTOCONDUCTIVE LAYER OF PERSISTENT CONDUCTIVITY-TYPE ELECTROPHOTOGRAPHIC RECORDING MEMBER

FIELD OF INVENTION

This invention concerns electrophotographic recording members for use in persistent conductivity-type electrophotographic recording processes and, more specifically, copolymers which may be employed as binders in the photoconductive layer of persistent conductivity-type electrophotographic recording members.

BACKGROUND

There are several known electrophotographic methods for the reproduction of images. Typically in such processes, a latent image is formed in a photosensitive material, then developed and transferred to a final receptor surface, e.g., a paper sheet.

In one technique, known as persistent conductivity, the latent image comprises an imagewise pattern of non-conductive and conductive regions in the imaging layer of a persistent conductivity-type recording member. Such recording members typically have a multilayered construction. The first layer, sometimes called a base layer, is non-conductive, and typically comprises, for example, paper, polypropylene, polyester terephthalate, etc. On a side of the first layer, is the imaging or photoconductive layer, typically comprising a photosensitive material dispersed in a resinous binder material. Examples of commonly used photosensitive materials include zinc oxide, lead sulfide, cadmium sulfide, selenium or combinations thereof. An example of a resinous binder material commonly used in persistent conductivity-type recording members is styrene/-butadiene copolymer. In some instances, the persistent conductivity-type recording member may further comprise a conductive layer or coating disposed on the underside of the nonconductive layer, i.e., the side opposite that which the photoconductive layer is on. Such conductive layers are intended to provide a more effective ground potential to the back side of the recording member, thereby improving the resolution of images formed therewith via a persistent conductivity process.

In a persistent conductivity process, image reproduction is achieved by exposing the recording member, which is in an initially substantially uncharged and dark condition state, to light in imagewise fashion, thereby increasing the conductivity of the light-struck portions of the recording member. Development of the latent image is then achieved by application of toner to the surface of the recording member under the influence of an electric field tending to attract the toner to the surface of the recording member and a magnetic field tending to attract the toner back to the toner station. The toner deposited on the light-struck portions of the recording member loses at least some of its induced charge due to the conductivity of those portions of the sheet and is removed by the magnetic field. The toner on the non-light-struck portions of the recording member substantially retains its charge because of the relatively non-conductive nature of the non-light-struck portions of the sheet, such that the effect of the electric field upon the induced charge exceeds the strength of the magnetic field thereby causing the toner to remain on the non-light-struck portions of the recording member. The imagewise deposit of toner on the surface of the recording member is typically then transferred to a final receptor such as a paper sheet or an intermediate receptor such as a web for subsequent transfer to the final receptor. Such a process is taught by Shely in U.S. Pat. Nos. 3,563,734 and 3,764,313. Thus it is seen that the latent image, i.e., region of increased conductivity, of a recording member used in such a recording process must remain, i.e., "persist", at least long enough to be developed. The latent image should resist reverting to its dark, i.e., nonconductive state, when subjected to the electric field of the toner station, and should quickly dissipate the induced charge from the toner so as to reduce the tendency for toner to be deposited in the background. Also, the recording member should be such that an effective differential in conductivity is achieved between the light-struck and non-light-struck portions thereof such that good toner deposition is achieved in the desired regions while the background remains substantially clear.

The construction and properties of persistent conductivity-type recording members typically differ from those of recording members used in other electrophotographic reproduction processes. For instance, in xerography, the photoconductive layer is on a conductive layer, e.g., an aluminum film or a paper sheet having a conductive coating thereon. Thus, the photoconductive layer is disposed directly on a conductive layer, contrary to the construction of a recording member for use in a persistent conductivity process. The recording member may further comprise a base layer on the opposing side of the conductive layer to strengthen the mechanical properties of the recording member. In the xerographic process, the latent image is formed by charging the xerographic recording member with a substantially uniform static charge, e.g., by exposure to a corona discharge, and then exposing the member to light, thereby increasing the conductivity of the recording member in the light-struck areas and causing the charge in those areas to be reduced whereas the non-light-struck areas substantially retain their initial charge. Such latent images are then developed by depositing toner on the surface of the recording member. Toner is attracted to the non-light-struck areas of the recording member which substantially retain their initial charge, whereas the light-struck areas from which the initial charge has been bled off, substantially do not attract toner. The imagewise deposited toner can then be transferred to a receptor surface.

It has been taught that binders suitable for use in recording members used in xerography processes are not necessarily useful for use in persistent conductivity processes. For instance, U.S. Pat. No. 3,010,884 (Johnson et al.) discloses that a certain binder used in xerographic recording processes is not useful in a persistent conductivity process (column 2, lines 38–58).

In order to be suitable for use in the photoconductive layer of a persistent conductivity-type electrophotographic recording member, a binder must possess several physical and electrical characteristics. It must have good insulative properties so that the resultant photosensitive material/binder dispersion will have suitable electrical resistivity, dielectric constant, and dielectric strength. It should not provide a short circuit current path between the particles of photosensitive material, nor should it impede the current flow between such particles. The binder should eliminate parallel leakage paths around the particles caused by absorbed moisture. It should be solvent soluble and exhibit the ability to be wet and disperse, but not react with, particles of photosensitive materials to form a tough, flexible, non-tacky film that preferably has a smooth finished surface and is moisture resistant.

Many resins require special processing in order to be used as a binder for a photoconductive film. A polymer may contain contaminants or deleterious by-products from its manufacture, such as traces of salts or metals, which must be treated or removed before the resin will function satisfactorily. These contaminants, which may reduce the humidity resistance and alter the dielectric properties of the film, are typically removed by rinsing the resin flocculent with water. The remaining water must in turn be removed because it may interfere with proper formation of the photoconductive film. For instance, water typically causes zinc oxide particles to become tacky, thereby making it more difficult to uniformly disperse the photosensitive material throughout the binder, and tends to render the resultant film conductive, thereby forming an undesired image in those areas of the film which contain water.

One known binder, a copolymer of styrene and butadiene, is commonly used in conjunction with zinc oxide photoconductor systems. Forming a photoconductive film with that binder, which is typically blended with the photosensitive material in a ball mill mixer, is often difficult because it frequently exhibits wide variations in viscosity, dielectric characteristics, molecular weight distribution, and purity, as well as other critical functional properties. In order to achieve convenient replicatable performance with a ball mill mixer, the viscosity of the binder/photosensitive material mixture must be substantially consistent from batch to batch. If the viscosity is too high, the ball milling must be continued for a longer period, which tends to disturb the particle size distribution of the photosensitive material. As the particles of photosensitive material are ground into smaller size, the photospeed of the recording member may be enhanced, but at the expense of lower contrast. If the viscosity is too low, the photosensitive material may form agglomerates, rather than evenly disperse, thus rendering the resultant film difficult to photosensitize.

A coating composition containing the styrene/-butadiene copolymer may also be prepared with a homogenizer, but the binder must first be homogenized alone to lower its viscosity which is typically too high and to break up any gel particles before the photosensitive material is added and the mixture again passed through the homogenizer. The binder must be homogenized before the photosensitive material is added because the high homogenization pressures necessary to lower its viscosity and break up any gel particles will typically break down the particles of the photosensitive material thereby interfering with the photosensitive properties of the resultant film.

DETAILED DESCRIPTION OF INVENTION

The present invention provides a persistent conductivity-type electrophotographic recording member comprising a nonconductive layer and a photoconductive layer on one surface of the nonconductive layer, wherein the photoconductive layer comprises a photosensitive material substantially uniformly dispersed in a binder, the binder consisting essentially of a copolymer of styrene with at least one alkyl acrylate, the alkyl group of which comprises from four to twelve carbon atoms. Preferably, the copolymer has an acid value of less than about 2, and more preferably of less than about 1. The photoconductive layer may optionally further comprise a spectral sensitizing dye and/or titanium dioxide. The recording member may also further comprise a conductive layer, e.g., a vapor-coat of aluminum, on the under side of the nonconductive layer, i.e., the side of the nonconductive layer opposite to the side on which the photoconductive layer is disposed. The electrophotographic recording members provided herein may be used in a persistent conductivity type process for the reproduction of an image.

It has been found that a copolymer of styrene with an alkyl acrylate, the alkyl group of which comprises from four to twelve carbon atoms, or a combination of such alkyl acrylates, exhibits the properties necessary for use as a binder in such a recording member. Such copolymers have good insulative properties and are soluble in solvents, such as toluene, which are typically used in making the coating composition used to cast electrophotographic reproduction films. Films comprising such copolymers are tough and flexible, provide good adhesion to a variety of base materials, and are essentially optically transparent to the wavelengths of radiation commonly used in many persistent conductivity reproduction processes. Such copolymers exhibit consistency in their properties and can be conveniently and replicatably processed according to a predetermined routine to form a photoconductive film.

Exemplary alkyl acrylates for use in the invention include butyl acrylate, ethylhexyl acrylate, isooctyl acrylate, and lauryl acrylate. Alkyl acrylates having alkyl groups with fewer than four carbon atoms typically do not impart sufficient flexibility to photoconductive films formed therewith, and those having alkyl groups with more than twelve carbon atoms typically tend to result in an excessively soft film which is easily marred.

It has been found that the binder of a photoconductive layer of a persistent conductivity-type recording member should have a low "acid value", i.e., below 2 and preferably below 1, in order to achieve optimum photosensitive performacce. "Acid value", also sometimes referred to as "acid number", is a term used to express the degree of acidity of a substance, and is defined herein as the number of milligrams of potassium hydroxide required to neutralize the acidic constituents of one gram of material. It has been found that the aforementioned copolymers typically have an acid value of less than about 2, or even 1, and may have acid values of 0.5 or below.

A binder comprising essentially polymeric styrene may tend to be too brittle to be used in a photoconductive film. Increasing proportions of the alkyl acrylates described above in the copolymer tend to soften the resultant film, rendering it more flexible, and also tend to increase the hydrophobicity of the film thereby reducing unwanted image backgrounding. However, coating compositions containing binders comprising too little styrene may tend to be too thick to easily be cast as a film, even at low intrinsic viscosities. Binders with a monomer weight ratio of between about 30/70 and about 80/20 styrene to alkyl acrylate are preferred. Typically, binders with a monomer weight ratio of about 60/40 achieve the best combination of film processability and performance properties, and are therefor most preferred.

Preferred copolymers have an intrinsic viscosity of between about 0.3 and about 0.9 deciliter per gram because preparation of a coating composition and casting of a photoconductive film comprising such copolymers is easier in this range. Compositions comprising binders with lower intrinsic viscosities tend to be too thin to coat evenly, whereas those comprising binders with viscosities above that range tend to be too thick for easy coating. The photosensitive properties of the resultant films, however, do not appear to be affected by the intrinsic viscosity of the copolymer used, thus this preference is merely relevant to the method utilized for preparing the photoconductive film.

The copolymers may be prepared by reacting the alcohol form of the alkyl, such as isooctyl alcohol, with acrylic acid to form the alkyl acrylate which is in turn reacted with styrene to yield the styrene/alkyl acrylate copolymer. Alternatively, suitable styrene/alkyl acrylate copolymers are available commercially. For instance, a styrene/ethylhexyl acrylate copolymer having an intrinsic viscosity of about 0.67 deciliter per gram and a monomer weight ratio of about 60/40 is available from Union Carbide. Similarly, a styrene/butyl acrylate copolymer having an intrinsic viscosity of about 0.38 deciliter per gram and a monomer weight ratio of 60/40 is also available from Union Carbide.

Such copolymers provide advantages in the manner by which they may be processed to form a photoconductive film of a persistent conductivity-type recording member. For example, the copolymers of the present invention typically exhibit high consistency in their film formation properties from batch to batch. Because of this consistency, each batch of film coating may be conveniently prepared according to a standard processing routine. The ability to employ a standardized method is more convenient and avoids the potential problems of a processing method wherein substantial adjustments in critical process parameters must be made each time a film coating is prepared.

Another advantage over many prior art binders is that with the copolymers of this invention, photosensitive films for persistent conductivity-type recording members may be made using several grades of zinc oxide. Films comprising other binders, such as a styrene/butadiene copolymer, do not exhibit sufficient photosensitivity when prepared with lower, typically cheaper, grades of zinc oxide. The precise mechanism behind this phenomenon is not clear, but may be due to different dielectric properties of the binders and contaminants present in cheaper grades of zinc oxide.

A photoconductive film of a persistent conductivity-type recording member of the invention may be conveniently made in simple fashion. The order of mixing the components of the film coating is not critical, and other procedures may be followed which will achieve the advantages of this invention.

It is typically convenient to dissolve the styrene/alkyl acrylate copolymer in a minimal amount of a compatible presolvent before addition to larger processing vessels containing a primary solvent. The primary solvent is typically an organic solvent, such as toluene. Such presolution will reduce the time required for preparation of a coating composition and it is typically easier to handle a liquid than solid material. Compatible presolvents include organic solvents which are miscible with the primary solvent, and may in fact be the same solvent.

Solvation of the copolymer may be performed with continuous agitation until the copolymer is fully dissolved in the solvent. Conventional stirring methods, such as a spinning mixing blade or magnetic stirrer, are satisfactory.

Once the binder is completely dissolved, the photosensitive material, such as zinc oxide or cadmium sulfide, which is typically in a powder form, is added to the solution. Other conventional photosensitive materials or pigments are also added at this point. For instance, titanium dioxide is typically incorporated in photoconductive films of persistent conductivity-type electrophotographic recording members in amounts ranging from a weight ratio of about 1 part per 3 parts to about 1 part per 14 parts of zinc oxide to improve the memory properties of the resultant photoconductive film.

The optimum concentration of the coating composition is largely determined by the desired handling characteristics of the coating composition for the techniques used to form the photoconductive film. For instance, coating compositions at approximately 50 percent total solids will typically be easy to handle and coat, whereas coating compositions at approximately 60 percent or more total solids may be too viscous for easy handling.

The proper proportions of binder and total photosensitive materials for a particular formulation may be readily determined by trial and error. For instance, to produce a photoconductive film comprising USP 20, a pharmaceutical grade of zinc oxide, available from New Jersey Zinc Company, in a styrene/isooctyl acrylate binder, a photosensitive material-to-binder weight ratio of about 6.5:1 is preferred, although ratios of from about 4:1 to about 10:1 are useful. If relatively too much binder is used, the coating composition typically tends to become too thick for convenient processing and casting. Further, the photosensitivity of the resultant film, and image resolution may be reduced. If relatively too little binder is used, the photoconductor particles may not be bound sufficiently tightly for good conduction properties or proper film formation. The resolution and contrast of images formed in the resultant film may thus be reduced. Depending upon the particular application and specific grade of zinc oxide or other photosensitive material used, the optimum photosensitive material-to-binder weight ratio may be from about 1:1 to about 100:1.

Dispersion of the particles of photosensitive material substantially uniformly throughout the binder matrix is preferably performed with a homogenizer operated at a sufficient pressure, typically from about 1000 to about 8000 pounds per square inch, to break up the agglomerates of photoconductor materials. Coating compositions comprising copolymers of this invention may be conveniently prepared by a single pass through a homogenizer, unlike other binders, such as styrene/butadiene copolymers, which typically have to be passed through the homogenizer prior to addition of the photosensitive materials as well as after such addition. The mixture should be thoroughly agitated to prevent the photosensitive material from forming large clumps or randomly sticking to the sides of the mixing vessel and interfering with uniform dispersion throughout the binder solution. If the clumps are not avoided, the mixer may become plugged during operation or the resultant coating may not be physically and electrically uniform.

Other methods of breaking up the agglomerates and dispersing the photosensitive material may be used, but are less preferred. For example, ball milling, roll milling, and colloid milling may be used, but are all relatively slow in comparison to homogenizing. Roll milling suffers from evaporation of solvent and loss of solution, and colloid milling is less effective if large agglomerates are present. Contrary to a homogenizer, which mixes the binder and photoconductor powder with a shearing action that effectively disperses the various components without significantly altering the size of the particles of photosensitive material, a ball mill mixes with a more destructive crushing action that may grind the particles of photosensitive material into smaller grains, thereby upsetting the particle size distribution of the photoconductor particles and increasing the surface area of the photoconductor powder. This phenomenon may cause changes in several properties which are dependent upon surface area of the photosensitive material, such as the film's tendency to absorb moisture, conductivity, and photospeed, the reactivity of the photosensitive material with sensitizing dyes, and the contrast between image and background which may be achieved.

Another advantage of the homogenizer is that it is a continuous process. This enables the preparation of the precisely amount of photosensitive coating mixture actually needed. A batch process, such as the ball mill, may only be used to produce photoconductive coating composition in increments of its capacity, regardless of how much is needed at a particular time.

Once the dispersion of binder and photosensitive materials is thoroughly mixed and agglomerates of photosensitive material are broken up so that they are substantially uniformly dispersed throughout the binder matrix, an effective amount of one or more spectral sensitizing dyes, may be added if desired. It will normally be convenient to first dissolve the sensitizing dye or dyes in a suitable solvent, such as methyl alcohol, before addition to the dispersion because many sensitizing dyes are not soluble in toluene or other commonly used binder resin primary solvents. Methyl alcohol or other solvents which will dissolve the dye and which are miscible in the binder primary solvent are suitable and permit the thorough mixing of the sensitizing dye throughout the dispersion. The spectral sensitizing dyes are preferably added in a simple mixing vessel after the dispersion has been prepared to prevent staining of the more sophisticated equipment used to disperse the photosensitive material throughout the binder.

The prepared coating composition is then cast on a side of the nonconductive layer, e.g., a sheet of paper, polyester, or polypropylene, in a manner known to those skilled in the art. Suitable coating techniques include cascade, reverse roll, and curtain coating.

The coating rate is preferably adjusted to cast a film with a dry thickness of at least about 5 microns. Typically, an ideal dry thickness is about 25 microns. Films having thicknesses substantially below 25 microns may tend to have a lower photospeed and reduced resolution. Coating thicknesses substantially greater than 25 microns typically achieve no functional improvement in performance, and are therefore wasteful. Also, films with thicker coatings are more difficult to roll up, a common method of storing and handling persistent conductivity-type electrophotographic films.

After coating, the dispersion is dried to form the photoconductive sheet. Drying may be accomplished at room temperature over a period of time, or at elevated temperatures. The temperature limits which may be used are determined in part by the melting point of the substrate and the lower explosive limits of the solvents used to prepare the coating mixture.

The utility of this invention will be further explained by the following illustrative examples which are intended to be descriptive and nonlimiting. Unless otherwise indicated, all proportions are in parts by weight.

EXAMPLES 1-3

Example 1 illustrates the use of a styrene/isooctyl acrylate copolymer as the binder in the photoconductive film of a persistent conductivity-type recording member.

Isooctyl alcohol was reacted with acrylic acid to yield isooctyl acrylate.

Seventeen parts of isooctyl acrylate were then mixed in a reaction vessel with 25.5 parts of styrene; 57.4 parts of toluene; and 0.02 part of Trigonox 29-B-75, a polymerization catalyst comprising 75 percent peroxide and 25 percent dibutyl phthalate available from Noury Chemical Company; and put under a vacuum of approximately 25 inches of mercury. The mixture was heated to and held at a temperature of about 203° F. until the percentage of free styrene was less than two percent. The percent solids of this reaction product was approximately 40 with the remainder being substantially toluene. The styrene/isooctyl acrylate copolymer produced had an intrinsic viscosity of about 0.63 deciliter per gram, a monomer weight ratio of about 60/40, and an acid value of less than 1.

The photoconductive film was prepared by mixing 42.5 parts of the reaction product described above with 64.5 parts of toluene and 10.0 parts of n-butanol with a mechanical stirrer. After mixing, 72.3 parts of USP 20, a pharmaceutical grade zinc oxide available from New Jersey Zinc Company, and 10.6 parts of Horsehead A430, a titanium dioxide formerly available from Gulf & Western Natural Resources Group, were added to the solution, and the mixture was blended by passing once through a Gaulin Model 15M8BASMD Homogenizer, available from Manton-Gaulin Manufacturing Company, Inc., operated at a pressure of 4,000 pounds per square inch. Rhodamine B, a spectral sensitizing dye available from Aldrich Chemical Company, at a concentration of 0.073 part, was dissolved in 3.4 parts of methanol, and the solution then mixed with the homogenized dispersion to complete the coating composition.

The coating composition was then cast on the top side of a sheet of polyester approximately 0.9 mil thick, having a dielectric constant of approximately 4.0 with a layer of vapor coated aluminum on the bottom side. The sheet was fed through a knife coater at a speed of approximately 10 feet per minute and dried by passing through a 25 foot long oven, the maximum temperature of which was approximately 196° F., to form a film having an approximate thickness of 25 microns when dry. Upon exit from the oven, the film was wound into a roll.

The composition of the resultant film, which had a photosensitive material-to-binder weight ratio of approximately 4.88:1, was as follows:

| Component | Amount |
|---|---|
| Styrene/Isooctyl Acrylate Copolymer | 17.0 parts |
| Zinc Oxide | 72.3 parts |
| Titanium Dioxide | 10.6 parts |
| Rhodamine B Sensitizing Dye | 0.073 part |

The film was then tested on a PYROFAX Brand Platemaking System Model MR-404, manufactured by the Minnesota Mining and Manufacturing Company. Samples of the film were exposed for different times to determine the time required to obtain an open 3 exposure on a reflection grey scale having an optical increment or step density of approximately 0.15. The average required time of exposure was determined to be approximately 35 seconds.

In Example 2, a similar film was prepared using a styrene/ethylhexyl acrylate copolymer as the binder for the photoconductive film. The copolymer had an intrinsic viscosity of about 0.67 deciliter per gram, a monomer weight ratio of about 60/40, and an acid value of less than 1. This film was tested in the same manner as in Example 1. The average required time of exposure was determined to be approximately 35 seconds.

In Example 3, a similar film was prepared using a styrene/butyl acrylate copolymer as the binder for the photoconductive film. The copolymer had an intrinsic viscosity of about 0.38 deciliter per gram, a monomer weight ratio of about 60/40, and an acid value of less than 1. The film was tested in the same manner as in Examples 1 and 2. The average required time of exposure was determined to be approximately 35 seconds also.

These films were slower than is normally preferred for commercial use, wherein an exposure time of about 10 to 15 seconds to achieve an open 3 exposure is typically desired. However, the images produced each had good resolution, indicating that a styrene/alkyl acrylate copolymer could be used as the binder in the photoconductive layer of a persistent conductivity-type recording member if such layer was formulated with optimum dye loading and pigment-to-binder ratio.

EXAMPLES 4–10

Examples 4–10 illustrate the effects of different dye loads and photosensitive material-to-binder weight ratios on the photosensitivity of photoconductive films comprising a styrene/isooctyl acrylate binder.

Each film was prepared and tested according to the materials, proportions, and method used in Example 1 except the dye load and photosensitive material-to-binder (hereinafter "P.M.-to-B.") weight ratios were changed as indicated in Table I. A P.M.-to-B. weight ratio of 6:1 corresponds to 74.6 parts zinc oxide, 11.0 parts titanium dioxide, and 14.3 parts resin; a ratio of 6.5:1 corresponds to 75.5 parts, 11.1 parts, and 13.3 parts, respectively; and a ratio of 7:1 corresponds to 76.3 parts, 11.2 parts, and 12.5 parts, respectively.

The films in each example were exposed as in Example 1 to form good quality images with high resolution. The best combination of processability and photosensitive performance was found to occur at a P.M.-to-B. weight ratio of approximately 6.5:1, particularly in Examples 9 and 10, where the fastest photospeeds were achieved. Importantly, the increase in photospeed between Example 9 and Example 10 indicates that the dye saturation point has not been reached, thereby providing greater flexibility in formulating a photoconductive film with a desired photospeed.

The results were as follows:

TABLE I

| Example | Dye (Parts) | P.M.-to-B. Weight Ratio | Exposure (Seconds) |
|---|---|---|---|
| 4 | 0.146 | 6:1 | 60 |
| 5 | 0.073 | 6.5:1 | 50 |
| 6 | 0.146 | 7:1 | 38 |
| 7 | 0.197 | 6.5:1 | 22 |
| 8 | 0.241 | 6.5:1 | 20 |
| 9 | 0.292 | 6.5:1 | 16 |
| 10 | 0.343 | 6.5:1 | 11 |

EXAMPLES 11–14

Examples 11–14 illustrate the use of a styrene/isooctyl acrylate binder, having an intrinsic viscosity of about 0.63 deciliter per gram and monomer weight ratio of about 60/40 with different grades of photosensitive zinc oxide. Films were prepared with four different grades of zinc oxide purchased from the New Jersey Zinc Company, including USP 20. PHOTOX 8, PHOTOX 80, and PHOTOX 801, commercial grades recommended for use in photoconductive films, were also used.

Each film was formulated at a photosensitive material-to-binder weight ratio of 6.5:1 with 75.5 parts of the indicated grade zinc oxide, 11.1 parts titanium dioxide, 13.3 parts resin, and 0.292 part Rhodamine B sensitizing dye. The films were prepared and tested according to the methods described in Example 1.

Images with good resolution were achieved in each film, indicating that a styrene/isooctyl acrylate copolymer can be used as a binder for photoconductive films with a variety of zinc oxides. Films made with less expensive grades of zinc oxide were unexpectedly found to have greater photosensitivity than films produced with the more expensive pharmaceutical grade of zinc oxide.

The results were as follows:

TABLE II

| Example | Zinc Oxide Grade | Exposure (Seconds) |
|---|---|---|
| 11 | USP 20 | 27 |
| 12 | PHOTOX 8 | 12 |
| 13 | PHOTOX 80 | 9 |
| 14 | PHOTOX 801 | 7 |

EXAMPLE 15 AND COMPARATIVE EXAMPLES A–K

Example 15 and Comparative Examples A–K illustrate the use of a binder material of the invention and two other binder materials in electrophotographic recording members of both the persistent conductivity-type and xerographic-type which were imaged in both the persistent conductivity mode and xerographic mode.

In each example, an electrophotographic recording member was formed as follows. A coating composition comprising about 91.50 parts of zinc oxide (combination of PHOTOX 80 and PHOTOX 90, 50 weight percent each), about 8.44 parts of the indicated binder, and about 0.06 parts Rhodamine B, was coated upon the indicated base material to form a photoconductive layer of about 25 microns dry thickness thereon. Where a xerographic base material is indicated, a sheet of conductive paper was used, i.e., a paper impregnated with a conductive coating supplied as "electrostatic backing paper" by P.H. Glatfelter Paper Co. Where a persistent conductivity base material is indicated, a 0.9 mil thick polyester terephthalate film with an aluminum vapor coat on the underside thereof was used.

The resultant recording members were then imaged in both the persistent conductivity mode and the xerographic mode. In each mode, the film was exposed with light from a quartz iodide lamp transmitted through a conventional lens system that removed much of the ultraviolet and near infrared wavelengths of light. Unless otherwise indicated, the exposure time was about 10 to 15 seconds as necessary to achieve an open 3 exposure on the grey scale as in Examples 1–3. The film specimens were then toned with a monocomponent toner comprising magnetite ($FeO_4$), carbon black, and epoxy (an approximate weight ratio of 59/39/2).

Where persistent conductivity mode is indicated, the film, from an initially dark and uncharged state, was moved into the film plane of a PYROFAX Brand Platemaking System Model MR-404 and exposed, then moved past a toner station at a web speed of about 4 inches/second and under an applied electric field of about 1250 volts. The toner station comprised a rotating magnetic head which was located about 9 mils from the surface of the film such that the toner on the rotating head was brought into contact with the film.

Where xerography is indicated, the film was cut into sheet specimens, and then from an initially dark and uncharged state, given a uniform surface charge by corona treatment with an A.C. corona operated at about 5 kilovolts. The specimens were then exposed similarly as in the aforementioned PYROFAX system and then toned.

The materials and conditions used in Example 15 and Comparative Examples A–K, and the results thereof are tabulated in Table III wherein the following abbreviations are used:

| Abbreviation | Meaning |
|---|---|
| S/IOA | Styrene/Isooctyl Acrylate copolymer (60/40 monomer weight ratio), having an acid value of less than 1. |
| S/EHA/AA | Styrene/Ethylehexyl Acrylate/ Acrylic Acid (60/37/3 monomer weight ratio), having an acid value of about 8.3. |
| AROTAP | AROTAP 3212-T-50, an acrylic binder available from Ashland Chemical Company |
| PC | Persistent Conductivity |
| X | Xerographic |

TABLE III

| Example | Binder | Base | Mode | Results |
|---|---|---|---|---|
| 15 | S/IOA | PC | PC | Excellent image with good resolution and clear background. |
| A | S/IOA | PC | X | Weak image with poor resolution and high background. |
| B | S/IOA | X | PC | Very weak image with high background. |
| C | S/IOA | X | X | Very weak image with poor resolution and high background. A 12 point type image was not legible. |
| D | S/EHA/AA | PC | PC | Weak image with high background. Took 25 seconds to expose. |

TABLE III-continued

| Example | Binder | Base | Mode | Results |
|---|---|---|---|---|
| E | S/EHA/AA | PC | X | Failed to image, no deposition of toner after 180 seconds exposure. |
| F | S/EHA/AA | X | PC | High background with poor half tones and poor resolution after 180 second exposure. |
| G | S/EHA/AA | X | X | Good image with acceptable resolution and half tone range. |
| H | AROTAP | PC | PC | High background with poor half tones and poor resolution after 50 second exposure. |
| I | AROTAP | PC | X | High background, image barely distinguishable over background. |
| J | AROTAP | X | PC | Poor photosensitivity, 180 second exposure did not achieve open 3 exposure. |
| K | AROTAP | X | X | Good image with clear background. |

Example 15 illustrates the successful use of a binder of the invention in a photoconductive layer of an electrophotographic recording member imaged in the persistent conductivity mode. Photoconductive layers made with the same binder yielded unsatisfactory results when imaged in the xerography mode whether on a persistent conductivity-type base or a xerography-type base, as shown in Comparative Examples A and C. In Comparative Example B, the same photoconductive layer on a xerography-type base also yielded unsatisfactory results when imaged in the persistent conductivity mode.

In Comparative Example G, a photoconductive layer on a xerography-type base was successfully imaged in the xerography mode whereas in Comparative Examples D–F the same photoconductive layer could not be imaged in the persistent conductivity mode on either base, nor could it be imaged in the xerography mode on a persistent conductivity base. Similar results were obtained in Comparative Examples H–K.

It should also be noted that a recording member comprising a binder having an acid valve of about 8.3 did not provide satisfactory results in the persistent conductivity mode (Comparative Examples D and E) whereas a recording member of the invention, wherein the binder had an acid valve of less than 1, provided excellent results in such a mode (Example 15).

Thus it is shown that binder materials useful in recording members in a persistent conductivity process (Example 15) are not necessarily useful in a xerography process (Comparative Examples A and C). It is further shown, that binder materials useful in recording members in a xerography process (Comparative Examples G or K), are not necessarily useful in a persistent conductivity process (Comparative Examples D and F or H and J, respectively).

Various modifications and alterations of this invention will become apparent to those skilled in the art without departing from the scope and spirit of this invention.

What is claimed is:

1. A persistent conductivity-type electrophotographic recording member comprising a nonconductive layer and a photoconductive layer disposed on one surface of said nonconductive layer, wherein said photoconductive layer comprises a photosensitive material substantially uniformly dispersed in a binder, said binder having an acid value of less than 2 and consisting essentially of a copolymer of styrene with at least one alkyl acrylate, the alkyl group of which comprises from four to twelve carbon atoms.

2. The recording member of claim 1 wherein said binder has an acid value of less than 1.

3. The recording member of claim 1 wherein said alkyl acrylate is selected from the group consisting of butyl acrylate, ethylhexyl acrylate, isooctyl acrylate, and lauryl acrylate.

4. The recording member of claim 1 wherein the monomer weight ratio of styrene to alkyl acrylate in said copolymer is between about 30/70 and about 80/20.

5. The recording member of claim 1 wherein the monomer weight ratio of styrene to alkyl acrylate in said copolymer is about 60/40.

6. The recording member of claim 1 wherein said photoconductive layer further comprises a spectral sensitizing dye.

7. The recording member of claim 1 wherein the photosensitive material-to-binder weight ratio is between about 1:1 and 100:1.

8. The recording member of claim 1 wherein said photosensitive material is zinc oxide.

9. The recording member of claim 8 wherein the photosensitive material-to-binder weight ratio is between about 4:1 and 10:1.

10. The recording member of claim 9 wherein said photosensitive material-to-binder weight ratio is about 6.5:1.

11. The recording member of claim 1 wherein said photoconductive layer further comprises titanium dioxide.

12. The recording member of claim 1 further comprising a conductive layer on the underside of said nonconductive layer.

13. A method wherein the recording member of claim 1 is used in a persistent conductivity process for the reproduction of an image.

* * * * *